US011799218B2

(12) United States Patent
Genau et al.

(10) Patent No.: US 11,799,218 B2
(45) Date of Patent: Oct. 24, 2023

(54) CONTACT ELEMENT FOR ELECTRICALLY CONNECTING PRINTED CIRCUIT BOARDS AND METHOD FOR ASSEMBLING A PRINTED CIRCUIT BOARD ARRANGEMENT

(71) Applicant: HARTING ELECTRONICS GMBH, Espelkamp (DE)

(72) Inventors: Marc Genau, Espelkamp (DE); Rainer Bussmann, Espelkamp (DE)

(73) Assignee: HARTING ELECTRONICS GMBH, Espelkamp (DE)

( * ) Notice: Subject to any disclaimer, the term of this patent is extended or adjusted under 35 U.S.C. 154(b) by 0 days.

(21) Appl. No.: 17/627,941

(22) PCT Filed: Jul. 10, 2020

(86) PCT No.: PCT/DE2020/100603
§ 371 (c)(1),
(2) Date: Jan. 18, 2022

(87) PCT Pub. No.: WO2021/013297
PCT Pub. Date: Jan. 28, 2021

(65) Prior Publication Data

US 2022/0294133 A1 Sep. 15, 2022

(30) Foreign Application Priority Data

Jul. 19, 2019 (DE) ..... 10 2019 119 588.8

(51) Int. Cl.
*H01R 12/58* (2011.01)
*H01R 12/70* (2011.01)
*H01R 13/11* (2006.01)

(52) U.S. Cl.
CPC ..... *H01R 12/58* (2013.01); *H01R 12/7064* (2013.01); *H01R 13/112* (2013.01)

(58) Field of Classification Search
CPC .. H01R 12/58; H01R 12/7064; H01R 13/112; H01R 12/52; H01R 12/718;
(Continued)

(56) References Cited

U.S. PATENT DOCUMENTS 3,665,375 A * 5/1972 Thoms ..... H01R 12/721 439/692
3,902,776 A * 9/1975 Williams ..... H01R 12/718 439/62

(Continued)

FOREIGN PATENT DOCUMENTS

CN 107004987 A 8/2017
DE 101 07 711 A1 8/2001

(Continued)

OTHER PUBLICATIONS

European Patent Office, International Search Report and Written Opinion for international application No. PCT/DE2020/100603, dated Sep. 29, 2020, 12 pages (with English translation of International Search Report).

(Continued)

*Primary Examiner* — Truc T Nguyen
(74) *Attorney, Agent, or Firm* — SEED IP LAW GROUP LLP

(57) ABSTRACT

A contact element for establishing electrical contact between a first and a second printed circuit board is provided. The contact element has a fastening region for fastening to the first printed circuit board and a plug section for a plug connection to the second printed circuit board. The plug section has at least two contact arms which are electrically conductively connected to one another. A method for assembling a printed circuit board arrangement is also provided.

12 Claims, 10 Drawing Sheets

(58) Field of Classification Search
CPC ..... H01R 12/712; H01R 13/02; H01R 13/40; H01R 43/00; H05K 3/36
See application file for complete search history.

(56) References Cited

U.S. PATENT DOCUMENTS

| | | | | |
|---|---|---|---|---|
| 4,017,135 | A * | 4/1977 | Taguchi | H01R 12/58 439/82 |
| 4,270,829 | A * | 6/1981 | Wilson | H01R 12/718 439/83 |
| 4,363,529 | A * | 12/1982 | Loose | H01R 12/7058 439/82 |
| 4,420,215 | A * | 12/1983 | Tengler | H01R 13/26 439/682 |
| 5,427,546 | A | 6/1995 | Garritano et al. | |
| 5,567,167 | A * | 10/1996 | Hayashi | H01R 12/52 439/82 |
| 6,497,579 | B1 | 12/2002 | Garbini | |
| 10,665,976 | B2 * | 5/2020 | Hoyack | H01R 12/7082 |
| 2001/0015887 | A1 | 8/2001 | Sanada et al. | |
| 2006/0003616 | A1 | 1/2006 | Narui et al. | |
| 2006/0024985 | A1 | 2/2006 | Nagata et al. | |
| 2007/0072488 | A1 * | 3/2007 | Xue | H01R 13/652 439/544 |
| 2007/0105436 | A1 * | 5/2007 | Shen | H01R 12/89 439/571 |
| 2007/0202719 | A1 * | 8/2007 | Saka | H05K 3/308 439/83 |
| 2010/0297866 | A1 * | 11/2010 | Ju | H01R 13/2485 439/342 |
| 2011/0195617 | A1 | 8/2011 | Aboulkassem et al. | |
| 2012/0315806 | A1 | 12/2012 | Myer et al. | |

FOREIGN PATENT DOCUMENTS

| | | | |
|---|---|---|---|
| DE | 60 2005 000 768 | T2 | 12/2007 |
| DE | 10 2005 030 375 | B4 | 7/2009 |
| DE | 10 2008 064 590 | B3 | 7/2010 |
| DE | 10 2016 107 898 | B4 | 4/2019 |
| EP | 1 157 448 | B1 | 7/2003 |
| EP | 1 929 848 | B1 | 4/2009 |
| FR | 2 693 340 | A1 | 1/1994 |
| JP | 2001110481 | A | 4/2001 |
| WO | WO 2007036181 | A1 | 4/2007 |
| WO | 2017/048913 | A1 | 3/2017 |

OTHER PUBLICATIONS

German Patent Office, Office Action for German application No. 10 2019 119 588.8 dated May 19, 2020, 7 pages.

Office Action, dated Jul. 21, 2023, for Chinese Patent Application No. 202080051697.9. (10 pages).

* cited by examiner

CONTACT ELEMENT FOR ELECTRICALLY CONNECTING PRINTED CIRCUIT BOARDS AND METHOD FOR ASSEMBLING A PRINTED CIRCUIT BOARD ARRANGEMENT

BACKGROUND

Technical Field

This disclosure relates to a contact element for establishing an electrical contact between a first and a second printed circuit board, and furthermore relates to a method for assembling a printed circuit board arrangement.

Such a contact element for establishing an electrical contact between a first and a second printed circuit board has a fastening region for fastening the contact element to the first printed circuit board and a plug portion for a plug connection to the second printed circuit board.

In a generic method for assembling a printed circuit board arrangement, it is provided that a fastening region of at least one contact element is fastened to a first printed circuit board and that a plug portion of the at least one contact element is connected to a second printed circuit board. An electrical contact between the first and second printed circuit board is established by the at least one contact element.

The printed circuit boards can be arranged in particular parallel to one another and can, in principle, be used in substantially any technical applications. The contact element serves for transmitting electrical signals and/or electrical energy between the printed circuit boards, i.e., between circuits of the two printed circuit boards.

An exemplary field of use is in vehicles, in which the printed circuit boards belong to different motor components or other vehicle components. In particular, vibrations and shocks occur in such automobile applications, resulting in the risk of a temporary interruption to the electrical contacting between the printed circuit boards or possible damage owing to the vibrations. If the printed circuit boards with the electrical contact element are pressed against one another under relatively high pressure for more reliable contacting, the printed circuit boards could become deflected in the long term.

Description of the Related Art

A coaxial connector for providing an electrical connection between two printed circuit boards is described in DE 60 2005 000 768 T2 and in EP 1 157 448 B1. DE 10 2005 030 375 B4 discloses a plug connector, which is assembled on a first printed circuit board and makes contact with a socket or electrical contact region of a second printed circuit board. DE 101 07 711 A1 uses a flexible printed circuit to connect two printed circuit boards. EP 1 929 848 B1 describes a connection between two printed circuit boards which are arranged perpendicularly to one another, wherein one of the printed circuit boards has hook-shaped regions which engage in holes of the other printed circuit board.

If known contact elements enable a connection between two printed circuit boards that is reliable with regard to vibrations, this is only achieved by relatively complex and therefore expensive contact elements.

The German Patent and Trademark Office has searched the following prior art in the priority application relating to the present application:

DE 10 2005 030 375 B4, DE 10 2008 064 590 B3, DE 10 2016 107 898 B4, DE 101 07 711 A1, DE 60 2005 000 768 T2, FR 2 693 340 A1, EP 1 157 448 B1, EP 1 929 848 B1 and WO 2017/048 913 A1.

BRIEF SUMMARY

According to embodiments of the present invention, a contact element and a method for assembling a printed circuit board arrangement are provided, which, with a simple construction, provide a reliable electrical connection between two printed circuit boards.

In the case of the contact element of the above-mentioned type, the plug portion inventively comprises at least two contact arms, which are connected to one another in an electrically conductive manner.

In the case of the above-mentioned method for assembling, i.e., constructing, a printed circuit board arrangement, the second printed circuit board inventively has at least one respective printed circuit board opening for each contact element. In the case of each contact element, the plug portion has at least two contact arms, which are connected to one another in an electrically conductive manner. The contact arms of each contact element are pushed through the respective printed circuit board opening in order to establish an electrical connection.

Owing to the plurality of contact arms, electrical contact of at least one of the contact arms can also be ensured in the event of vibrations. Since the contact arms are connected to one another in an electrically conductive manner, they can have the same electrical potential. If the contact element is used for signal transmission, the plurality of contact arms do not output different information or voltage levels but can be at substantially the same electrical potential. The contact element can therefore represent an individual contact.

The contact element and therefore the contact arms can be made from a metallic material. In this case, the contact arms are flexible or elastic or resilient relative to one another. This is important for reliable contacting, as will be explained in more detail below.

A contact arm has an elongated form, which can be in particular at least twice or at least three times the size of the largest cross-sectional dimension of the contact arm. In the present case, the direction of the elongated form is also referred to as the vertical direction or z direction. An electrical contact with the second printed circuit board, i.e., with an electrically conductive part of the second printed circuit board, can take place over the whole extent of the contact arm. The elongated form therefore enables greater positioning tolerances of the two printed circuit boards with respect to one another in the z direction. Vibrations in the z direction are also unproblematic, so as to ensure continuing electrical contact.

In some embodiments, the contact element has three or more contact arms, which are all connected to one another in an electrically conductive manner so that they in turn have the same electrical potential. At least three contact arms can be advantageous for ensuring continuous contact of at least one contact arm, even in the event of substantially randomly acting forces transversely to the z direction. Further details in this regard are described more precisely below.

The contact element can in particular be formed in one piece, i.e., it can consist of an individual part and not a plurality of components connected to one another, for instance. The individual part itself or a coating applied thereto is electrically conductive. These one-piece configurations enable cost-effective production and assembly. It is moreover ensured that the plurality of contact arms are connected to one another in an electrically conductive manner.

The contact element can have an elongated form along a longitudinal axis (x direction), wherein the contact arms extend in a vertical direction (z direction) perpendicularly to the longitudinal axis. The elongated form of the contact element in the x direction can be understood such that its extent in the x direction is substantially greater, for example at least three times greater, than in a transverse direction (y direction) which is perpendicular to the x direction. The first and the second contact arm can protrude on opposite sides of the longitudinal axis (x axis); in other words, the first contact arm can protrude from the longitudinal axis in the y direction, and the second contact arm can protrude from the longitudinal axis in the opposite direction. The at least two contact arms can thus be clamped in an associated printed circuit board opening of the second printed circuit board in the transverse direction. The first and second contact arm are therefore pressed towards one another in the y direction in the assembled state and are deformed or bent.

The contact arms can be spaced from one another along the longitudinal axis of the contact element (x direction). Contact between the contact arms is thus also prevented when the contact arms are bent, for example as a result of the contact arms pressing against the walls of the printed circuit board opening through which the contact arms project. The contact arms can likewise be spaced from one another in the y direction so that a deflection in the y direction is also enabled.

It may be preferred that the contact element has at least a third contact arm. In this concept, the second contact arm can be located between the first and third contact arm along the longitudinal axis of the contact element (x direction). The first and third contact arm now both protrude from the longitudinal axis in the transverse direction (y), whereas the second contact arm protrudes from the longitudinal axis in the opposite direction (−y). In the assembled state, in which the contact arms project into a printed circuit board opening, the first and third contact arm therefore contact the same side of the printed circuit board opening, whilst the second contact arm contacts the opposite side of the printed circuit board opening. This prevents the contact element from being able to rotate relative to the printed circuit board opening and thus lose the electrical contact.

In cross-section, i.e., in the xy plane, the contact arms can have a bent form, i.e., the form of a ring portion. In particular, in cross-section, the contact arms can be bent in the direction in which they protrude from the longitudinal axis of the contact element. In the assembled state, a contact arm thus generally contacts a wall of the printed circuit board opening with its central region. Electrical contact is thus more reliable than if contact were only established at an edge of the contact arm.

The contact arms can have a tapering form as an insertion aid when inserting the contact arms into a printed circuit board opening. The dimensions of the contact arms, in particular in the y direction, therefore become smaller, with an increasing spacing from the fastening region in which the contact element is connected to a first printed circuit board. At least the two outermost contact arms in the x direction can moreover have a region which slopes or tapers in the x direction as an insertion aid. The first contact arm is therefore sloped on a side which is remote from the second contact arm. In the case of three contact arms, the third contact arm is likewise sloped on a side which is remote from the second contact arm. As a result of the slope or taper, a greater tolerance with respect to positioning inaccuracies between the contact element and the associated printed circuit board opening is achieved. In particular, in embodiments to be described in more detail below, which comprise means as insertion aids, a greater tolerance with respect to positioning inaccuracies alone can also be achieved by the tapering form, without this form serving as an insertion aid.

The fastening region can generally comprise one or more projections, hooks or other geometries, which are suitable for a press, clamping or soldered connection to the first printed circuit board or components on the first printed circuit board. In particular, the fastening region can have at least two fastening feet for fastening the contact element to the first printed circuit board. The fastening feet can be inserted into corresponding cutouts in the first printed circuit board and can be held therein in particular by press fit and/or soldered therein. The fastening feet therefore project in the opposite direction to the contact arms in the vertical direction/z direction.

All contact arms can be arranged between the two fastening feet in the direction of the longitudinal axis/x direction. The fastening feet can moreover be located further away from the longitudinal axis in the transverse direction (y direction) than the length by which the contact arms extend in the transverse direction. As a result of this arrangement, the stability of the contact element on the first printed circuit board is increased. In particular, the contact element is prevented from tilting before soldering to the first printed circuit board is completed. In order to ensure correct insertion of the fastening feet into the associated cutouts of the first printed circuit board, the fastening feet can each have bearing surfaces, which bear on the first printed circuit board.

The present disclosure also relates to a contacting device having a plurality of contact elements, which are each formed as described in this disclosure. The contact elements can be formed identically to one another or also according to different embodiments described here. The contacting device moreover comprises an insulating body, in which, for each contact element, at least one fastening opening is formed in each case, into which the respective contact element projects. The fastening opening can have in particular a slot shape and hold the respective contact element by press fit. The insulating body is made from an electrically insulating material and holds the contact elements at a spacing from one another. The contact arms of the different contact elements each project from an upper side of the insulating body. The fastening feet of the contact elements project from an underside of the insulating body. The insulating body can be seated on the first printed circuit board and can be optionally held on the first printed circuit board by press fit. When seating the insulating body, fastening feet protruding at its underside are also inserted into the corresponding cutouts in the first printed circuit board.

As a result of the insulating body, all contact elements can be mounted on the insulating body in a first assembly step so that the insulating body with all contact elements can subsequently be assembled on the first printed circuit board in a single operating step. This separation of the assembly steps can be important for keeping the requirements for assembling the first printed circuit board as low as possible. In this case, the insulating body with the contact elements can be delivered in the pre-assembled state so that a customer can fasten the pre-assembled insulating body with the contact elements on a printed circuit board without a specific tool or special effort.

The insulating body can be formed in one piece, whereby production is facilitated. On its upper side, it can have at least two upwardly projecting adjusting pins, which are longer than the contact arms. The adjusting pins can moreover each have a tapering end. Corresponding adjusting holes for receiving the adjusting pins can be present in the second printed circuit board. During assembly, the adjusting pins are firstly inserted into the adjusting holes and only then do the contact arms come into contact with the second printed circuit board.

The invention also relates to a printed circuit board arrangement having at least one inventive contact element or at least one inventive contacting device. The printed circuit board arrangement moreover has a first printed circuit board, on which the at least one contact element, in particular all contact elements, are fastened, i.e., pressed therein or soldered thereto, for example. The printed circuit board arrangement moreover has a second printed circuit board, which can be arranged in particular parallel to the first printed circuit board or can be at an angle of inclination of a maximum of 45° to the first printed circuit board. The second printed circuit board has at least one printed circuit board opening for inserting the contact arms of the at least one contact element. In principle, a plurality of printed circuit board openings for the different contact arms of the same contact element can also be provided, although, for stable and cost-effective production, it may be preferred if all contact arms of a contact element project into or through the same printed circuit board opening. The second printed circuit board can accordingly comprise a respective printed circuit board opening for each contact element.

A printed circuit board opening can be formed by a hole in the second printed circuit board, which hole has a metallic coating. If the present disclosure states that a contact arm contacts the second printed circuit board, the printed circuit board opening or a wall of the printed circuit board opening, this can be understood such that the metallic coating is contacted in order to provide an electrical contact. The coating thickness can be in the μm range, whereby cost-effective production is enabled. In contrast to some conventional designs, the contact arms are not pressed against the second printed circuit board under a relatively high pressure by springs or in another manner, which would be associated with increased wear on the electrical contact surfaces of the second printed circuit board. Therefore, in the case of the invention, a thin coating in the μm range can be sufficient.

A coating is in particular suitable if the number of plug-in procedures is small, for example if only one-time assembly is intended. To provide greater robustness with regard to wear during the plug-in procedure, instead of a coated hole in the second printed circuit board, a contact socket can also be mounted on the second printed circuit board. The contact socket is made from an electrically conductive material and can be pressed into corresponding holes near to the printed circuit board opening, for example by way of holding projections.

The contact socket can be aligned with the associated printed circuit board opening so that its opening overlaps the printed circuit board opening completely. In this case, an opening or an opening width of the contact socket can be smaller than the associated printed circuit board opening. It is thus ensured that the contact arms contact the contact socket and not for instance the printed circuit board substrate or the coating near to the printed circuit board opening. The contact sockets are expediently arranged on the side of the second printed circuit board which is facing the first printed circuit board.

If contact sockets are used, descriptions stating that a contact element makes contact with the second printed circuit board or its printed circuit board opening should be understood such that the contact socket belonging to the printed circuit board opening is contacted. In modified embodiments, the contact arms can also project into the contact socket alone, without needing to provide additional holes into or through which the contact arms project in the second printed circuit board.

The printed circuit board opening or the contact socket can have a slot shape or form an elongated hole whereof the longitudinal direction corresponds to the longitudinal direction of the associated contact element. In this case, in the assembled state, the first and second contact arm contact opposite sides of the slot-shaped printed circuit board opening.

A width of the slot-shaped printed circuit board opening can be smaller than a width of the contact element, which is defined by the contact arms, in the non-assembled state. In the assembled state, the contact arms are thus bent by the slot-shaped printed circuit board opening. In particular, the first and second arm are therefore pressed towards one another in the transverse direction (i.e., perpendicularly to the longitudinal direction of the slot-shaped printed circuit board opening) or, in other words, bent towards the longitudinal axis of the contact element. Reliable contact between the contact arms and the printed circuit board opening or the associated contact socket is thus ensured.

Each contact element can have at least one supporting leg, which stands on the first printed circuit board in the assembled state.

The at least one supporting leg protrudes further in the direction of the first printed circuit board than the contact arms, so that a gap with respect to the first printed circuit board is formed below the contact arms. The gap also prevents a potentially disadvantageous contacting of the first printed circuit board when the contact arms are bent or deformed as a result of the contact with the second printed circuit board. It can be provided in particular that, in the assembled state, only the at least one supporting leg and optionally bearing surfaces of the fastening feet stand on the first printed circuit board, whilst remaining regions of the contact element, in particular the contact arms, are spaced from the first printed circuit board. The at least one supporting leg can also serve for positioning the fastening feet in the z direction relative to the first printed circuit board. In this case, the fastening feet protrude further than the at least one supporting leg.

The first printed circuit board can be electrically connected to the fastening feet. On the other hand, the first printed circuit board can be electrically insulated in regions in which it comes into contact with the at least one supporting leg, so that electrical contact is not generated here.

Each contact element can have a respective supporting leg between mutually adjacent contact arms. In the case of three contact arms, two supporting legs can therefore be provided, wherein, as seen in the xy plane, one supporting leg is arranged between the first and second contact arm and the other supporting leg is arranged between the second and third contact arm. This local proximity to the contact arms is important for preventing unwanted contact between the contact arms and the first printed circuit board in the event of a deflection of the contact arms.

Variants of the inventive method are revealed through the intended use of the described embodiments of the invention.

BRIEF DESCRIPTION OF THE SEVERAL VIEWS OF THE DRAWINGS

Exemplary embodiments of the invention are illustrated in the drawings and will be explained in more detail below.

The figures may contain partially simplified, schematic illustrations. Identical elements are generally denoted by corresponding reference signs.

DETAILED DESCRIPTION

Figure 1:
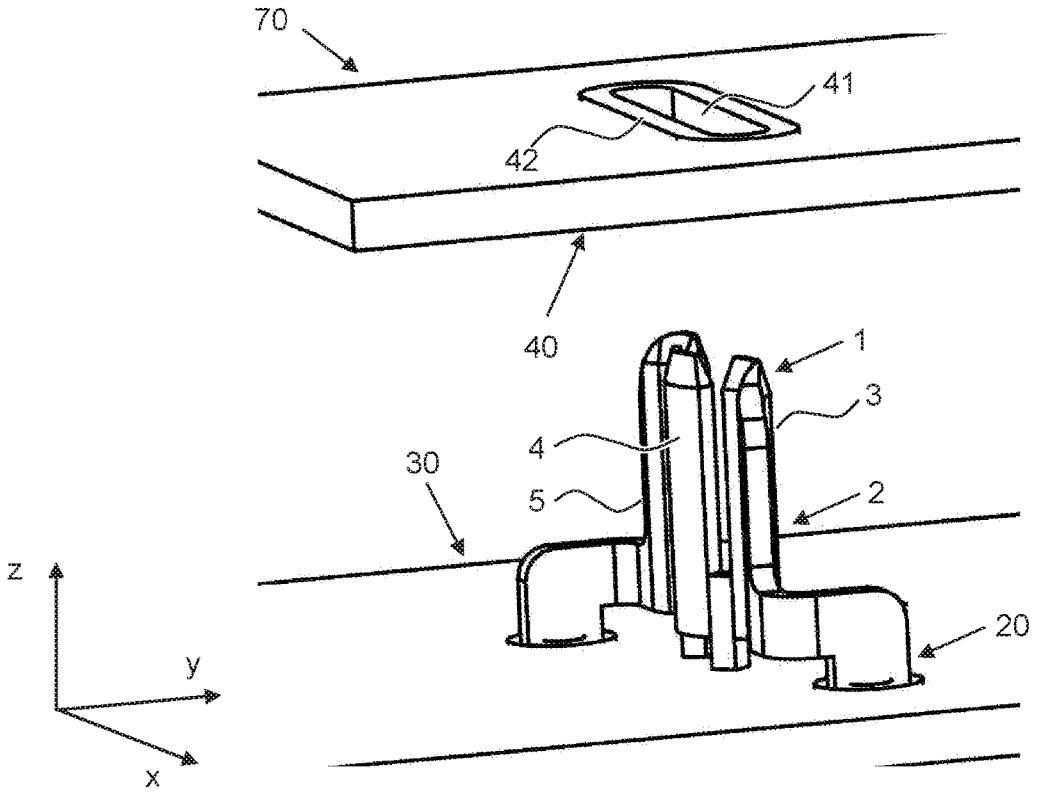
FIG. 1 shows a perspective illustration of a detail of a printed circuit board arrangement according to an inventive exemplary embodiment.
Figure 2:
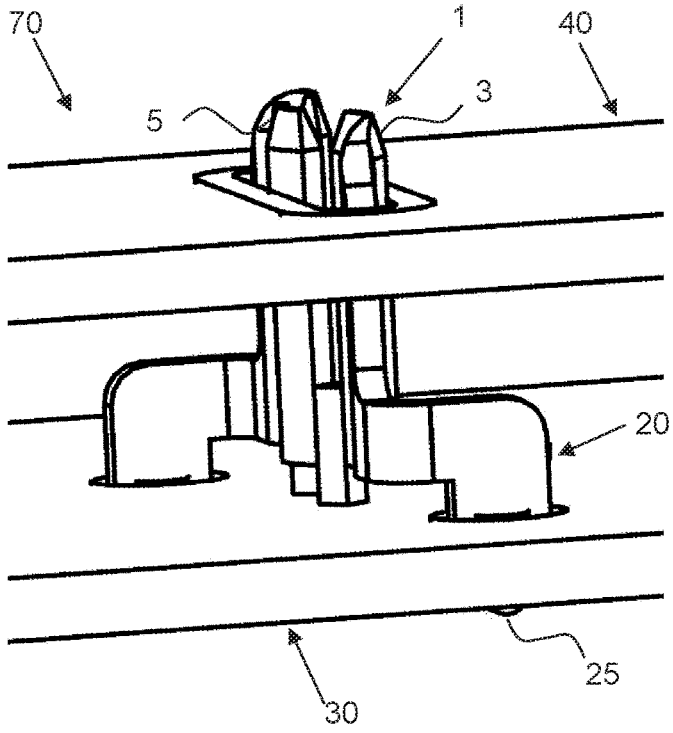
FIG. 2 shows a perspective illustration of a detail of the printed circuit board arrangement of FIG. 1 in an assembled state.

A first exemplary embodiment of a printed circuit board arrangement 70 according to the invention is described with reference to FIGS. 1 and 2. The printed circuit board arrangement 70 has a first printed circuit board 30 and a second printed circuit board 40, and a contact element 1 for electrically connecting the two printed circuit boards 30 and 40. FIG. 1 shows a partially assembled state, in which the contact element 1 is fastened to the printed circuit board 30, but is still spaced from the second printed circuit board 40. FIG. 2, on the other hand, shows the fully assembled state, in which the contact element 1 makes contact with the second printed circuit board 40 and establishes an electrical connection.

The two printed circuit boards 30 and 40 in the illustrated example are arranged parallel to one another but, more generally, can also be arranged at an angle of, for example, up to 30° to one another. The printed circuit boards 30 and 40 can be constituent parts of, in principle, any electronic devices and can belong for example to different motor components of a vehicle. A signal transmission and/or energy supply is intended to take place via the at least one electrical contact 1.

The contact element 1 has a fastening region 20, via which the contact element 1 is fastened to the first printed circuit board 30. A plug portion 2 of the contact element 1 serves for the electrical contacting of the second printed circuit board 40, i.e., electrically conductive regions or components of the second printed circuit board 40. The plug region 2 is formed by a plurality of elongated contact arms 3, 4, 5. In the assembled state, the contact arms 3, 4, 5 extend in the z direction, which, in the present case, is also referred to as the vertical direction. The first printed circuit board 30, or its surface, extends in the xy plane, so that the contact arms 3, 4, 5 are perpendicular to the first printed circuit board 30 or, in more general terms, are at an angle of a maximum of 10° with respect to the surface normal of the first printed circuit board 30.

The second printed circuit board 40 has at least one printed circuit board opening 41. In the illustrated example, this refers to an elongated hole in the second printed circuit board 40, which is provided with an electrically conductive coating 42. In the assembled state of FIG. 2, the contact arms 3, 4, 5 extend through the printed circuit board opening 41 and contact the coating 42. An electrical contact is therefore generated at the lateral surfaces of the contact arms 3, 4, 5 and not, for instance, at the tip or end face of the contact arms 3, 4, 5.

As can be seen from FIG. 2, this construction offers high tolerances and good robustness with regard to vibrations in the z direction. An imprecise arrangement of the two printed circuit boards 30 and 40 with respect to one another in the z direction has no effect on the electrical contact owing to the length of the contact arms 3, 4, 5. There is no risk of a loss of contact in the event of vibrations or other disruptive influences in the z direction. In this case, tension does not build up between the two printed circuit boards 30 and 40 in the z direction so as to ensure the electrical contacting. This is in contrast to some conventional configurations, in which a contact element is clamped between two printed circuit boards and the contact element makes contact with the underside of the second printed circuit board, for example, which is facing the first printed circuit board.

Figure 3:
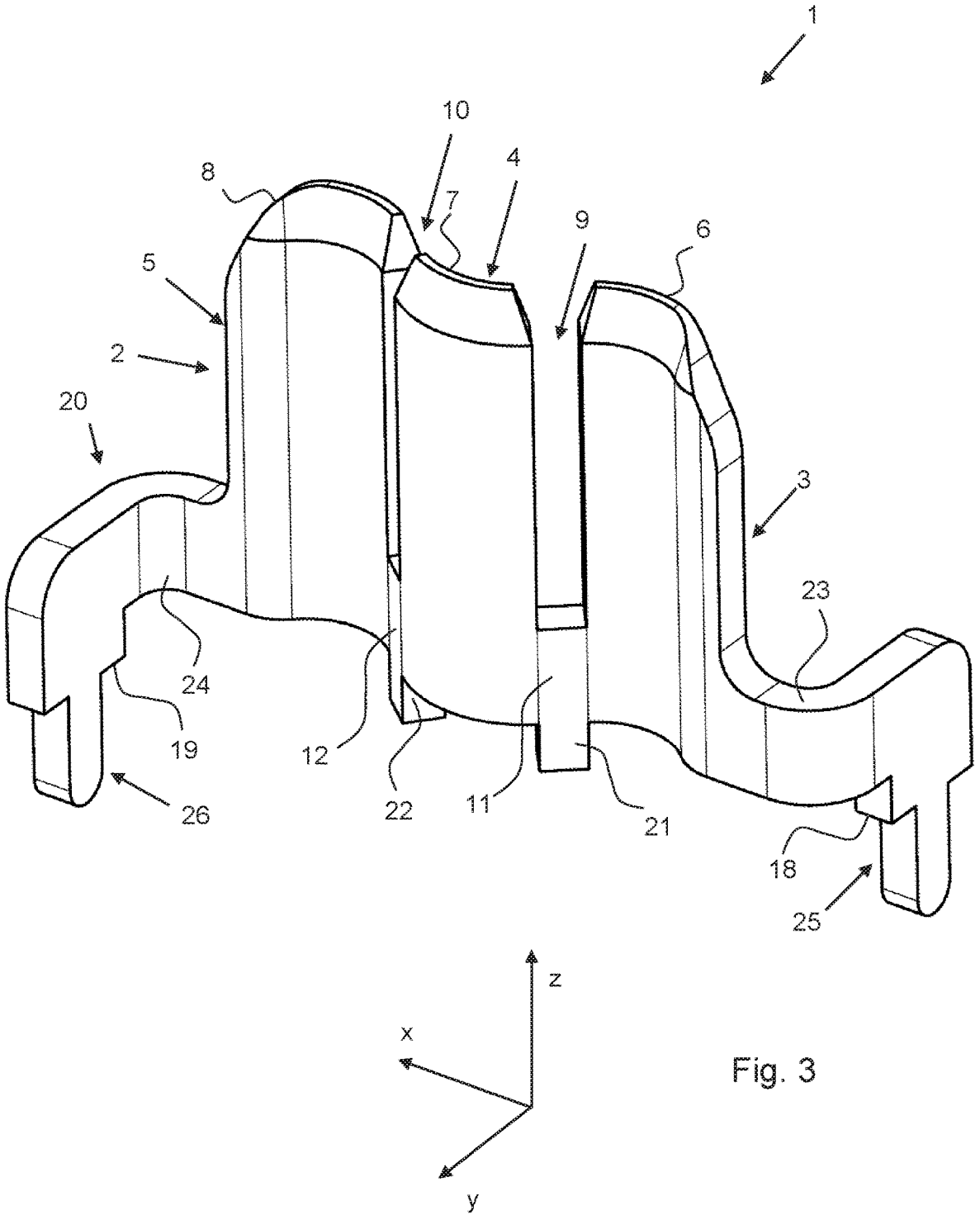
FIG. 3 shows a perspective illustration of the contact element of the printed circuit board arrangement of FIG. 1.

The contact element 1 of FIGS. 1 and 2 is shown on an enlarged scale in FIG. 3. It is formed in one piece, wherein, in principle, multi-part embodiments would also be possible. The contact arms 3, 4, 5 are connected to one another in an electrically conductive manner and have the same electrical potential in operation. The plurality of contact arms 3, 4, 5 thus act electrically as an individual contact. For reliable contacting with the second printed circuit board, the contact arms 3, 4, 5 are flexible or resilient relative to one another. This is achieved in that a connecting region 11 between the first and second contact arm 3, 4, and a connecting region 12 between the second and third contact arm 4, 5 is small compared to the length of the contact arms 3, 4, 5. By way of example, a z extent of the connecting regions 11 and 12 can be a maximum of 40% or a maximum of 30% of the z extent of the contact arms 3, 4, 5.

The contact arms 3, 4, 5 are arranged offset or in succession in the x direction, whereby the contact element 1 has an elongated form in the x direction which, in the present case, is also referred to as the longitudinal axis of the contact element 1. The fastening region 20 for mounting on the first printed circuit board is formed by a plurality of fastening feet 25 and 26. In the illustrated example, two fastening feet 25 and 26 are present, which extend in the opposite direction (−z) to the contact arms 3, 4, 5, i.e., in the opposite direction to the z axis. A bent or angled region 23, 24 in each case leads from the contact arms 3, 4, 5 to the respective fastening foot 25, 26. The contact feet 25 and 26 thus lie further out in the y direction, i.e., they are further away from the contact arms 3, 4, 5 in the y direction. This arrangement is important for ensuring reliable positioning of the contact element 1 on the first printed circuit board 30. In this case, the contact feet 25 and 26 are located on opposite sides with respect to the longitudinal or x axis.

The contact element 1 furthermore comprises bearing surfaces 18 and 19 on the contact feet 25 and 26. The bearing surfaces 18 and 19 are seated on the upper side of the first printed circuit board 30 and thus define how far the contact feet 25 and 26 project into or through corresponding cutouts in the first printed circuit board 30.

The contact element 1 moreover has a plurality of supporting legs 21, 22, which are likewise seated on the upper side of the first printed circuit board 30. As a result of the supporting legs 21 and 22, is it ensured that the contact arms 3, 4, 5 are spaced from the surface of the first printed circuit board 30. This is particularly reliably achieved in that the supporting leg 21 is arranged between the first and second contact arm 3, 4 and the supporting leg 22 is arranged between the second and third contact arm 4, 5, as seen in the xy plane.

The contact arms 3, 4, 5 each have a region 6, 7, 8 which tapers towards their plug-in end. Their insertion into the associated printed circuit board opening 41 of the second printed circuit board 40 can thus be facilitated. Moreover, the allowed tolerance with regard to imprecise positioning of the two printed circuit boards with respect to one another in the xy direction is thus increased. In particular, the outer contact arms 3 and 5 in the x direction each have a sloping surface, whereby the longitudinal or x extent of the contact arms 3, 4, 5 tapers towards the plug-in end. This sloping region can be omitted in the central contact arm 4 (or more generally in the central contact arms) or it can be smaller, whereby, for sufficient mechanical stability, the central contact arm 4 can be formed to be shorter in the x direction than the outer contact arms 3 and 5.

Figure 4:
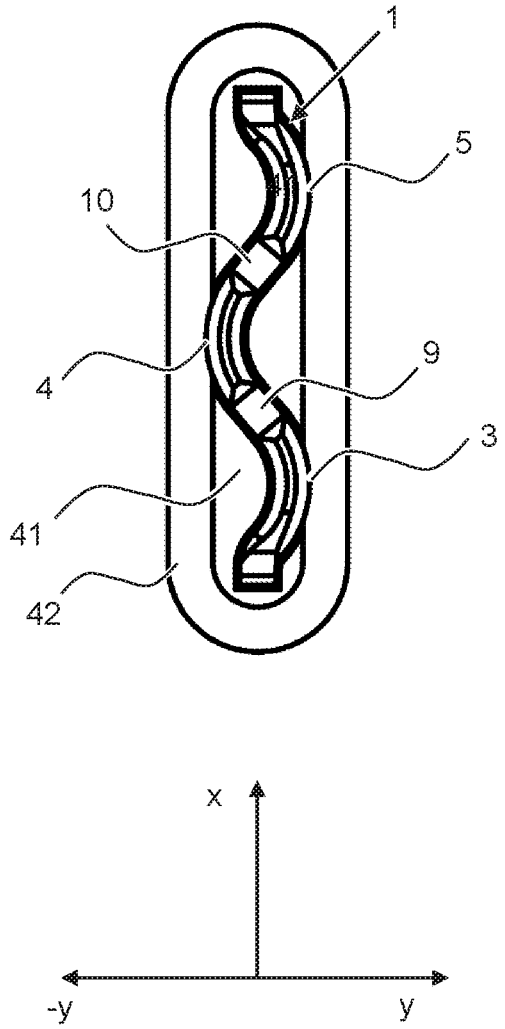
FIG. 4 shows a plan view of the contact element of FIG. 3.

FIG. 4 shows a plan view of the contact element 1, wherein it is inserted into a printed circuit board opening 41 of the second printed circuit board 40. As illustrated, the contact arms 3, 4, 5 are each spaced from one another by a gap 9 and 10 and contact the coating 42 of the printed circuit board opening 41. In this case, it is schematically shown that, in a non-assembled state, the y extent of the contact arms 3, 4, 5, as seen together, is greater than the y extent of the printed circuit board opening 41. As they are inserted into the printed circuit board opening 41, the contact arms 3, 4, 5 are therefore pressed together in the y direction. The first and third contact arm 3 and 5 project from a longitudinal or x axis of the contact element 1 in the positive y direction and thus contact one slot side of the printed circuit board opening 41, whilst the second contact arm 4 lying between them projects from the x axis of the contact element 1 in the negative y direction and thus makes contact with the opposite slot side. As they are inserted into the printed circuit board 41, the contact arms 3, 4, 5 are consequently bent in the negative y direction, whilst the contact arm 4 is deformed in the positive y direction. Particularly reliable contact in the y direction is thus achieved, even when vibrations or other disruptive forces act on the printed circuit board arrangement. In this case, it is important that adequate electrical contact is also realized if, for a short time, only one of the contact arms 3, 4, 5 contacts the coating in the event of jolting.

Figure 5:
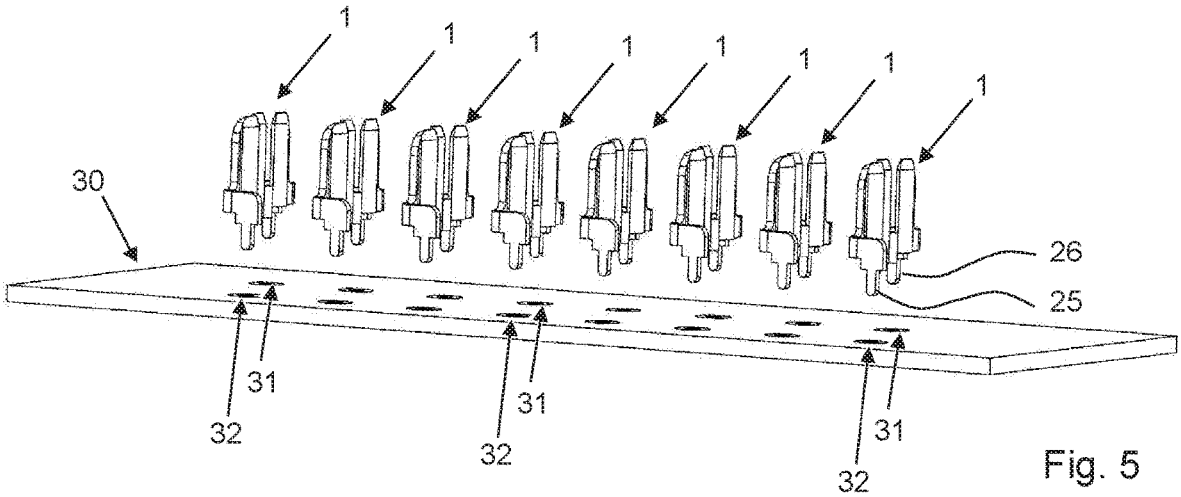
FIG. 5 shows a perspective illustration components of the printed circuit board arrangement of FIG. 1 in a non-assembled state.

FIG. 5 shows the assembly of a plurality of contact elements 1 on the first printed circuit board 30. The first printed circuit board 30 comprises cutouts 31 and 32 for the fastening feet 25, 26 of the respective contact elements 1. The fastening feet 25, 26 are inserted into the cutouts 31, 32 and are held therein by press fit or are soldered therein. The cutouts 31 and 32 can be continuous holes. This can be particularly advantageous for soldering, for which a length of the fastening feet 25, 26 from the bearing surfaces 18, 19 (see FIG. 1) can be dimensioned such that the fastening feet 25, 26 project completely through the first printed circuit board 30.

Figure 6:
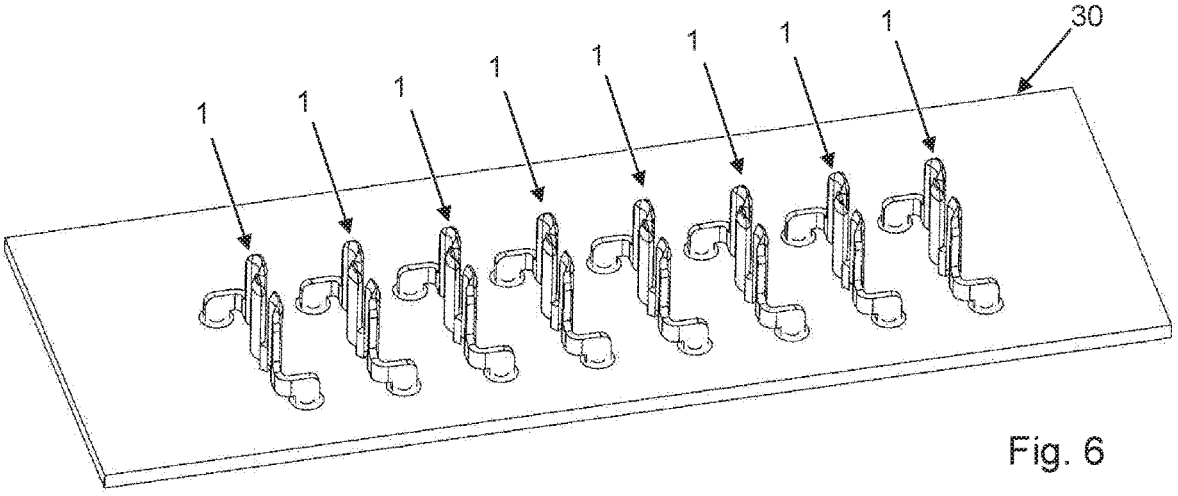
FIG. 6 shows a perspective illustration of components of the printed circuit board arrangement of FIG. 1 in a partially assembled state.

FIG. 6 shows, in a perspective plan view, a state in which the plurality of contact elements 1 are assembled on the first printed circuit board 30. The connection to the second printed circuit board 40 then takes place, as shown schematically in FIGS. 7 and 8. For each contact element 1, the second printed circuit board 40 has one printed circuit board opening 41 in each case, at which a respective electrical contact 1 is to be established. As illustrated in FIG. 8, the contact arms 3, 4, 5 of the contact elements 1 project through the respective printed circuit board openings 41 in the fully assembled state.

Figure 7:
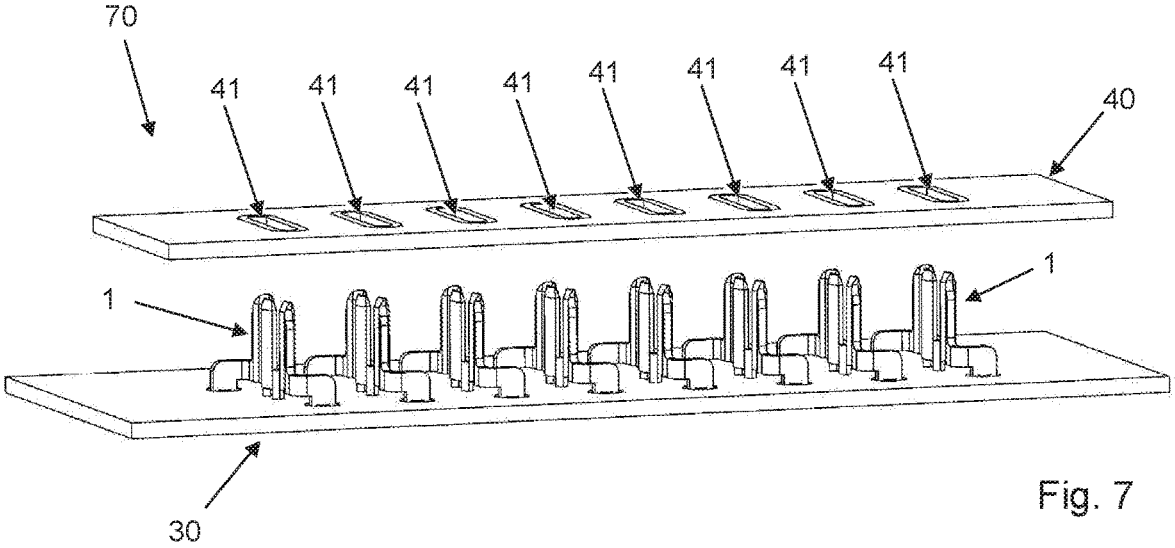
FIG. 7 shows a perspective illustration of the printed circuit board arrangement of FIG. 1 in a partially assembled state.
Figure 8:
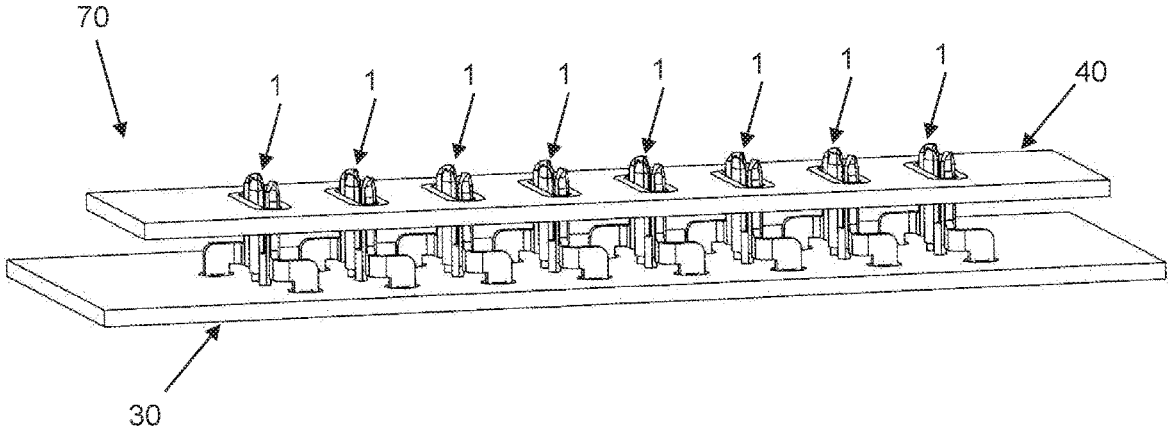
FIG. 8 shows a perspective illustration of the printed circuit board arrangement of FIG. 7 in an assembled state.
Figure 9:
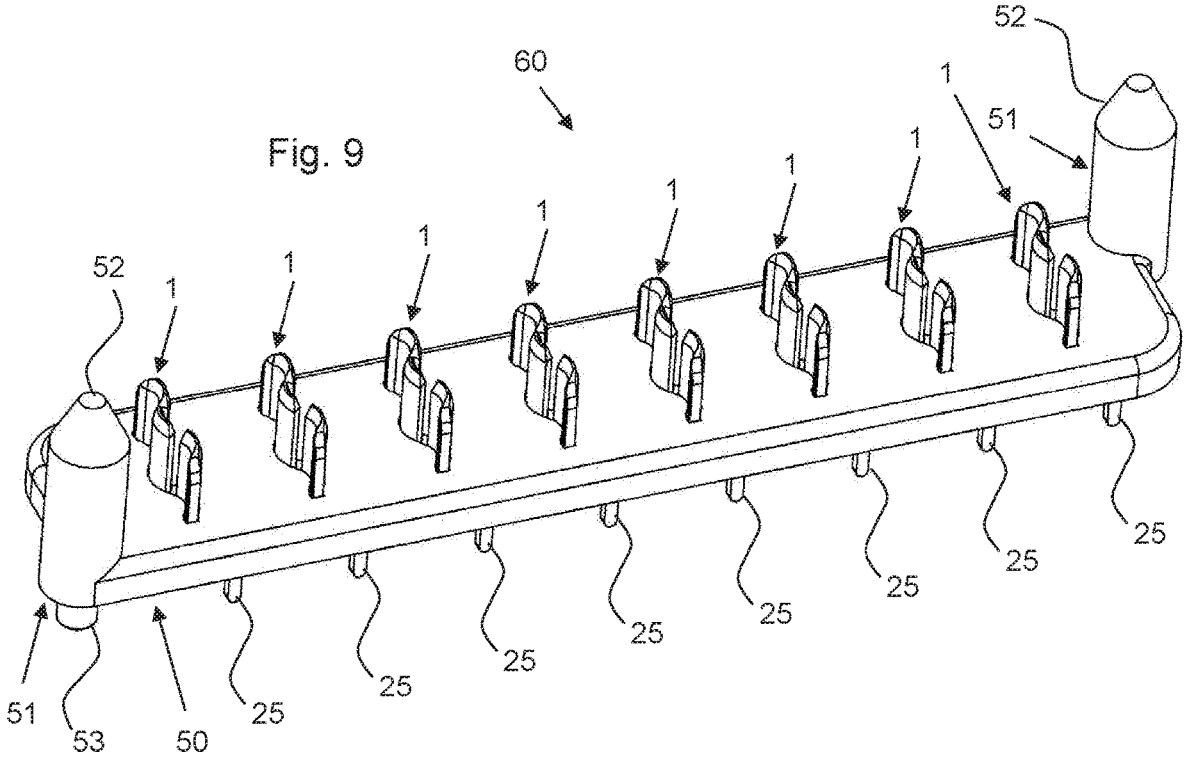
FIG. 9 shows a perspective view of a contacting device according to an inventive exemplary embodiment.
Figure 10:
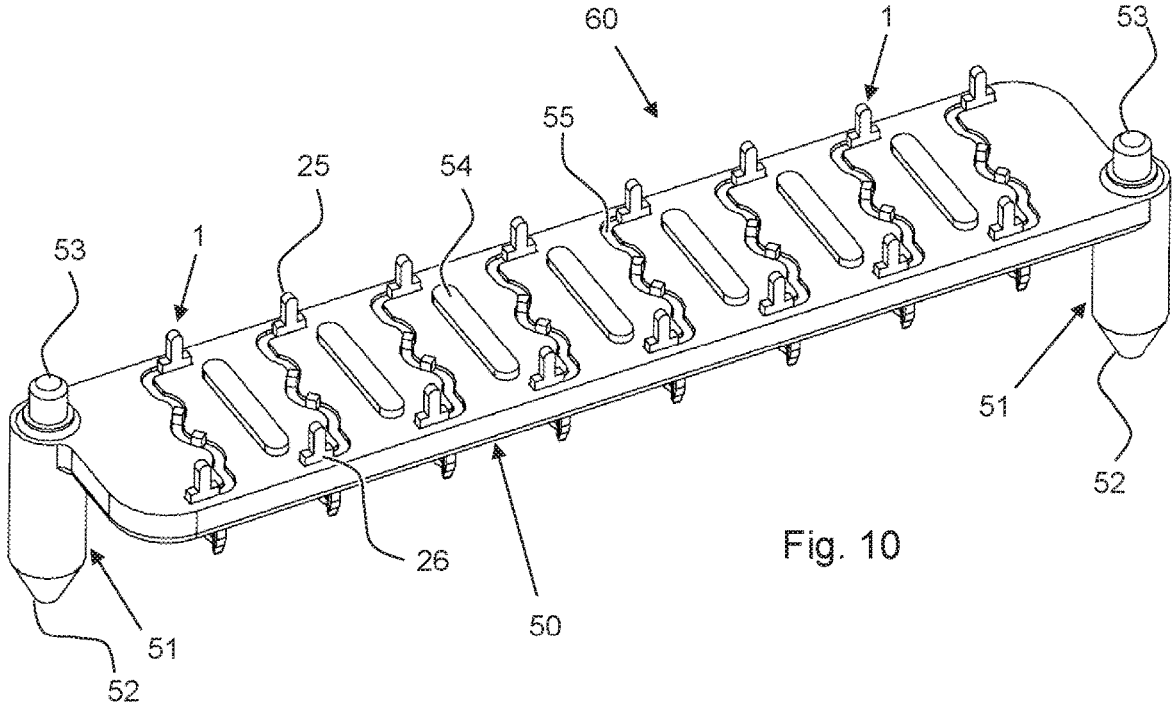
FIG. 10 shows a perspective illustration of the underside of the contacting device of FIG. 9.

In this exemplary embodiment of FIGS. 6 to 8, each contact element 1 is individually seated and assembled on the first printed circuit board 30. In order to reduce this assembly effort, in the exemplary embodiment of FIGS. 9 to 14, an additional insulating body 50 is used, which holds a plurality of contact elements 1. FIG. 9 shows the insulating body 50 in a perspective view, whilst FIG. 10 shows the insulating body 50 in a perspective view from below. The insulating body 50 has a plurality of fastening openings 55, into which the contact elements 1 are inserted or clamped. In the present case, the module comprising the insulating body 50 and a plurality of contact elements 1 is referred to as contacting device 60. The contacting device 60 is assembled as a whole on the first printed circuit board 30. To this end, the insulating body 50 comprises holding elements 53 (FIG. 10) on its underside, which are inserted or pressed into corresponding cutouts in the first printed circuit board 30. The insulating body 50 moreover has a plurality of projections 54 on its underside, which bear on the surface of the first printed circuit board 30 and thus ensure a precise z position of the contact elements 1 relative to the first printed circuit board 30. The fastening feet 25, 26 and the bearing surfaces 18, 19 and supporting legs 21, 22 shown in more detail in FIG. 3 protrude from the underside of the insulating body 50 so that they can contact the first printed circuit board 30 when the insulating body 50 is seated on the first printed circuit board 30.

Figure 11:
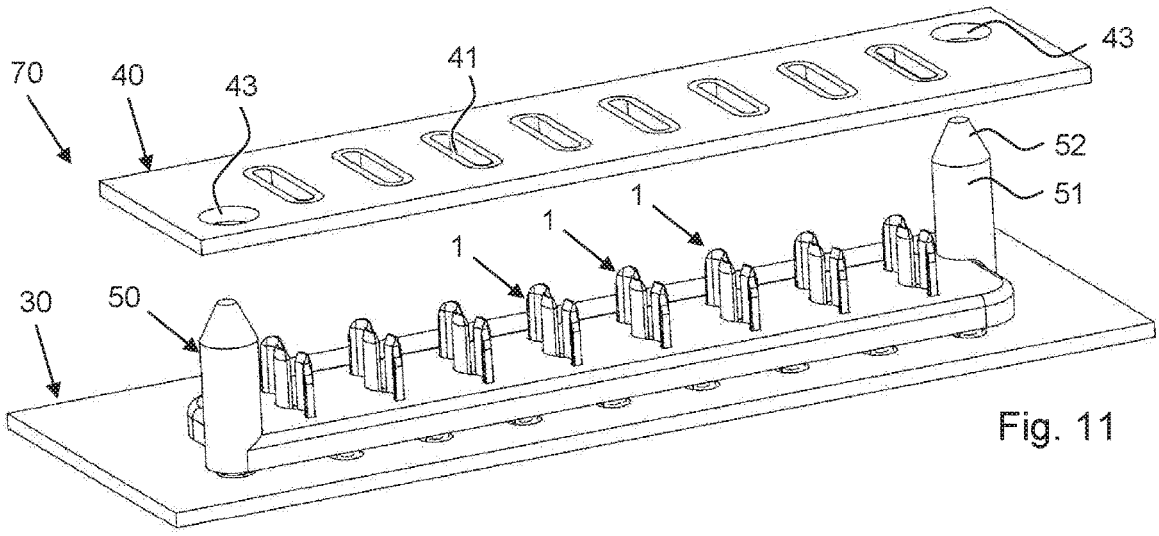
FIG. 11 shows a perspective illustration of a printed circuit board arrangement according to an inventive exemplary embodiment, comprising the contacting device of FIG. 9, in a partially assembled state.
Figure 12:
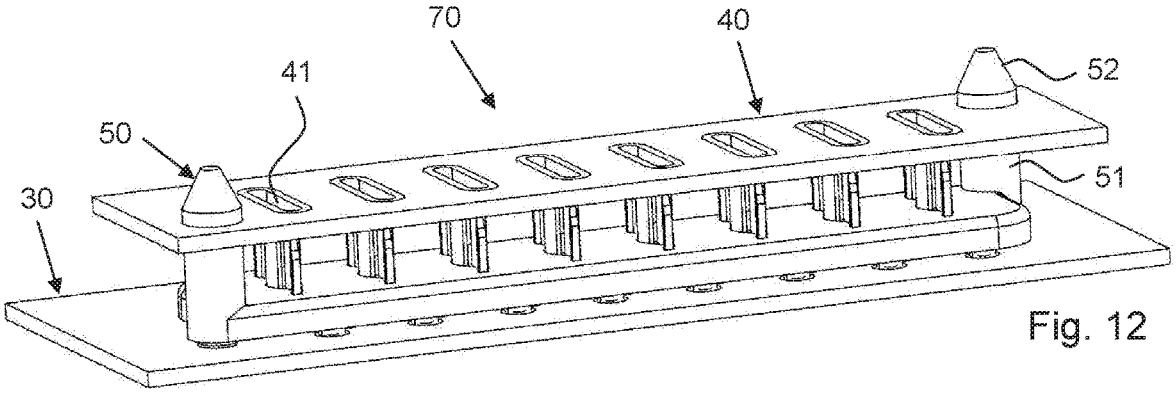
FIG. 12 shows a perspective illustration of the printed circuit board arrangement of FIG. 11 during assembly.
Figure 13:
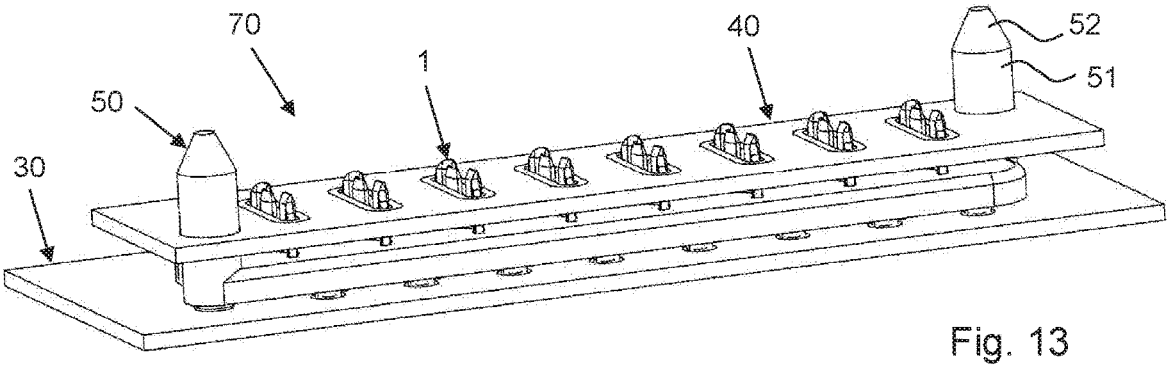
FIG. 13 shows a perspective illustration of the printed circuit board arrangement of FIG. 11 in an assembled state.

FIGS. 11 to 13 show the assembly procedure of the printed circuit board arrangement 70. In FIG. 11, the insulating body 50 is already connected to the first printed circuit board 30 and has a plurality of adjusting pins 51 which project further upwards from the printed circuit board 30 than the contact elements 1. The adjusting pins 51 are now inserted into corresponding openings 43 in the second printed circuit board 40, as shown in FIG. 12. Since the adjusting pins 51 each have a tapered end 52, correct xy alignment between the second printed circuit board 40 and the rest of the construction is facilitated. The second printed circuit board 40 is now moved further towards the first printed circuit board 30 until the contact arms 3, 4, 5 of the contact elements 1 project through the corresponding printed circuit board openings 41, as illustrated in FIG. 13. The adjusting pins 51 can optionally also have a holding geometry by means of which a movement of the second printed circuit board 40 towards the first printed circuit board 30 is restricted (not shown).

It is essentially also possible to connect more than two printed circuit boards in this way. A further printed circuit board, which is formed similarly to the second printed circuit board, can therefore be seated on the adjusting pins (not illustrated). The contact arms of the contact elements then project through the printed circuit board openings from the second and the further printed circuit board. Information or energy transmission can then optionally take place from one printed circuit board to one or more other printed circuit boards.

Figure 14:
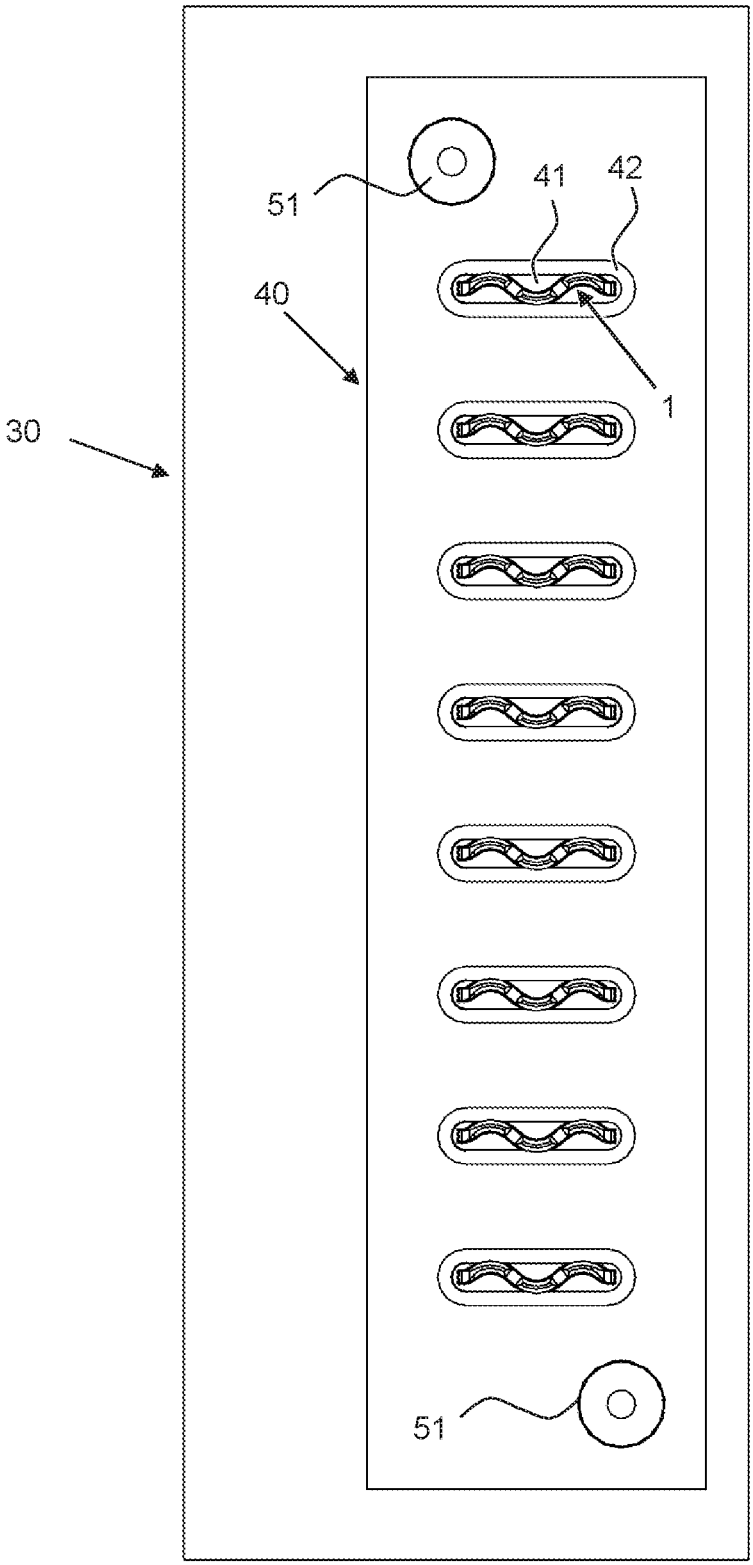
FIG. 14 shows a plan view of the printed circuit board arrangement of FIG. 13.

A plan view of the printed circuit board arrangement 70 of FIG. 13 is shown in FIG. 14. In the illustrated example, eight mutually independent electrical connections between the printed circuit boards 30, 40 are provided by eight contact elements 1.

Figure 15:
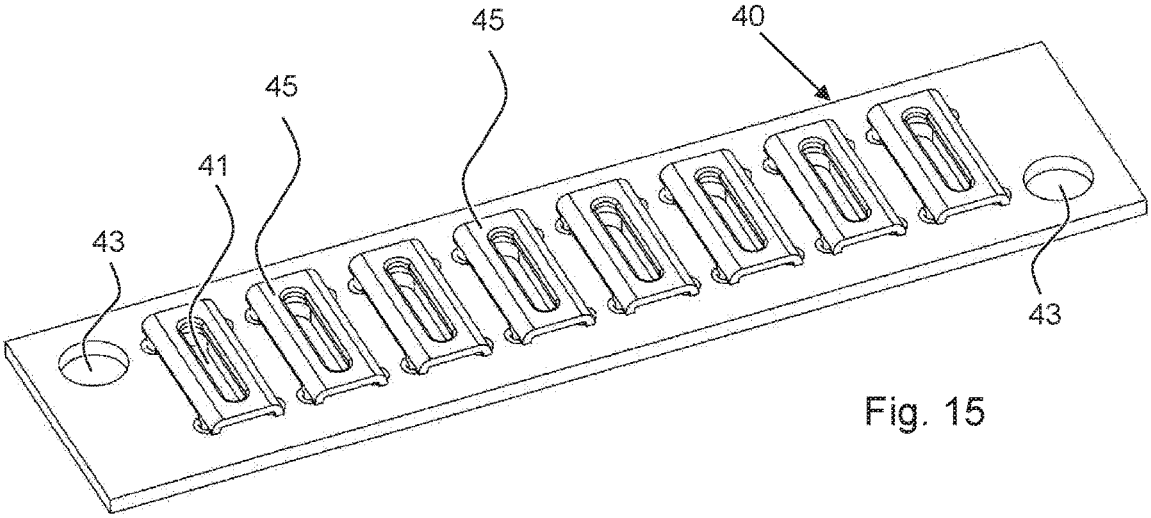
FIG. 15 shows a perspective illustration of a second printed circuit board of a printed circuit board arrangement according to a further inventive exemplary embodiment.

Whilst, in the previously described exemplary embodiments, a metallic coating 42 is present at the printed circuit board openings 41, this can be omitted in the exemplary embodiment of FIGS. 15 to 18. FIG. 15 shows the second printed circuit board 40 in a perspective view. Its printed circuit board openings 41 are not provided with a conductive coating here; instead, a respective contact socket 45 is arranged at each printed circuit board opening 41. An electrical connection is then established via contact between the contact arms 3, 4, 5 of a contact element 1 and the associated contact socket 45.

Figure 16:
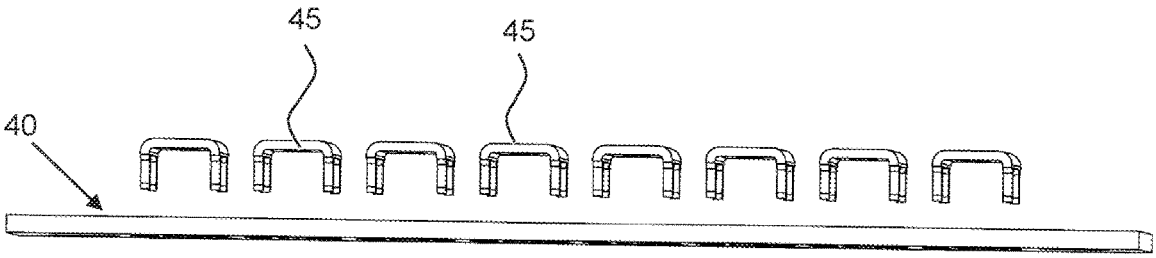
FIG. 16 shows a perspective illustration components of the printed circuit board arrangement of FIG. 15 in a non-assembled state.

FIG. 16 primarily illustrates the assembly of the contact sockets 45 on the second printed circuit board 40. The contact sockets 45 can each comprise pins, which are inserted into corresponding holding openings of the second printed circuit board 40 in order to ensure that the contact sockets 45 are held in place.

Figure 17:
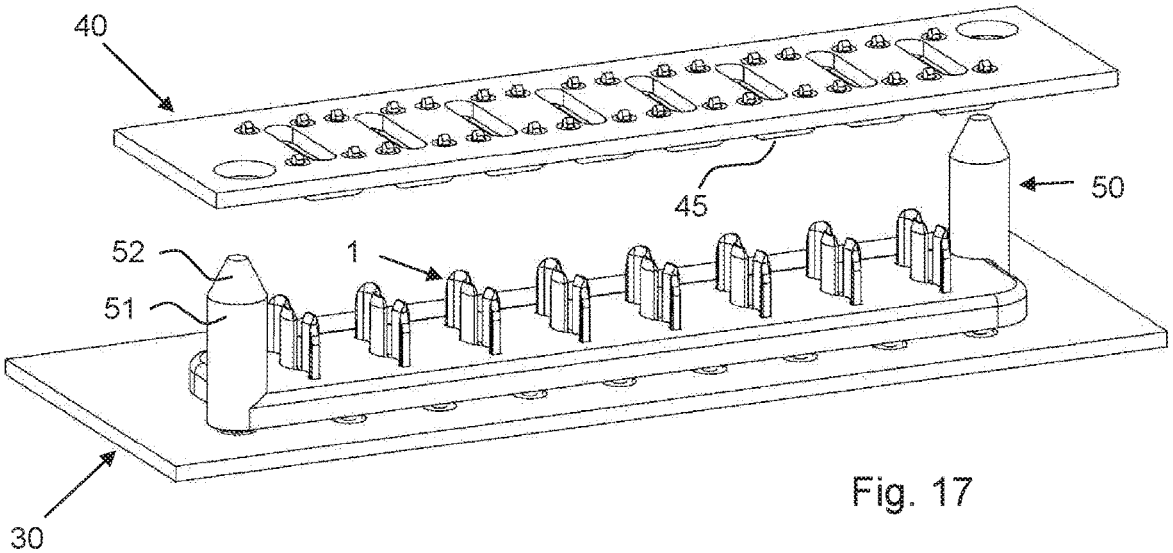
FIG. 17 shows a perspective illustration of the printed circuit board arrangement of FIG. 15 in a partially assembled state.
Figure 18:
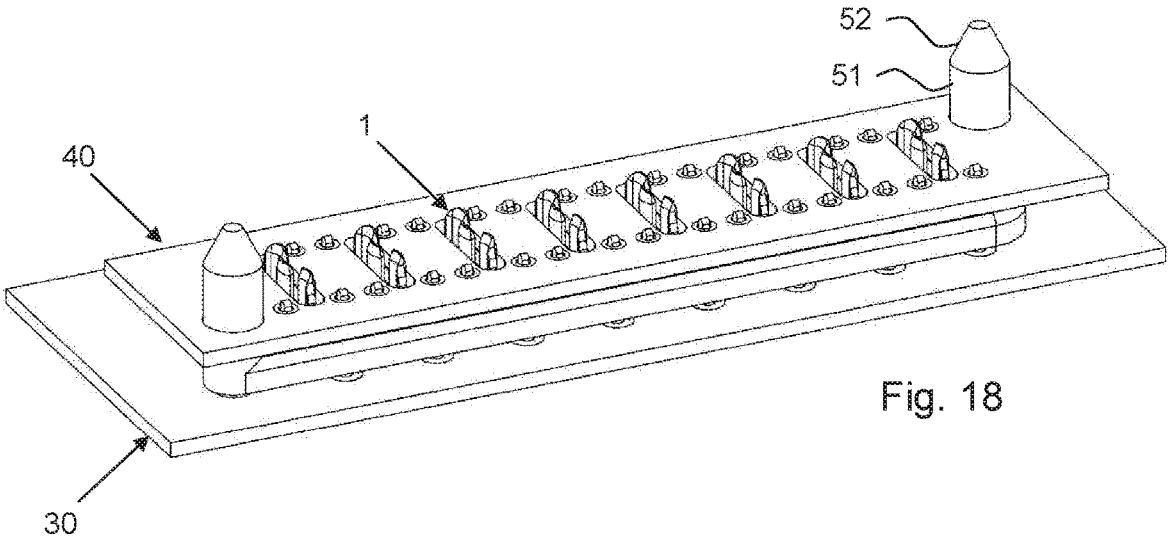
FIG. 18 shows a perspective illustration of the printed circuit board arrangement of FIG. 17 in an assembled state.

The first printed circuit board 30 with the insulating body 50 assembled thereon and the contact elements 1 can be formed in the manner of the previous exemplary embodiment. FIG. 17 shows that the contact sockets 45 are arranged on the side of the second printed circuit board 40 which is facing the first printed circuit board 30. In the assembled state, which is shown in FIG. 18, the contact elements 1 project through the contact sockets 45 and the printed circuit board openings 41, wherein they contact the contact sockets 45 and not, for instance, walls of the printed circuit board opening 41. As a result of the contact sockets 45, when compared to metallic coatings, a greater number of plug-in procedures can be enabled without resulting in significant wear.

As a result of the different embodiments described, reliable electrical contact between at least two printed circuit boards can be ensured even when vibrations or other disruptive forces occur in different directions. At the same time, there is no, or barely any, tension between the printed circuit boards which could cause deflections or other damage to the printed circuit boards in the long term. Apart from a certain pressing together of the contact arms in the y direction, there is also no, or barely any, tension on the contact elements, which means that the wear is low and the durability is correspondingly high.

Aspects of various embodiments described above can be combined to provide further embodiments.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A contact element for establishing an electrical contact between a first and a second printed circuit board comprising:

a fastening region for fastening to the first printed circuit board; and a plug portion for a plug connection to the second printed circuit board, and wherein the plug portion has at least two contact arms, which are connected to one another in an electrically conductive manner, wherein the contact element is formed in one piece, wherein the contact element has an elongated form along a longitudinal axis, and wherein the at least two contacts of the contact element comprise a first contact arm, a second contact arm and a third contact arm spaced from one another along the longitudinal axis, wherein the second contact arm is located between the first contact arm and the third contact arm along the longitudinal axis, and the first contact arm and the third contact arm both protrude from the longitudinal axis in a transverse direction, which is perpendicular to the longitudinal axis, whereas the second contact arm protrudes from the longitudinal axis in the opposing direction that is opposite of the transverse direction.

2. The contact element as claimed in claim 1, wherein all of the contact arms are connected to one another in an electrically conductive manner so that the contact arms have the same electrical potential and form an individual contact.

3. The contact element as claimed in claim 1, wherein each of the contact arms has a bent form in cross-section.

4. The contact element as claimed in claim 1, wherein each of the contact arms has a tapering form in cross-section.

5. A contact element for establishing an electrical contact between a first and a second printed circuit board comprising:

a fastening region for fastening to the first printed circuit board; and a plug portion for a plug connection to the second printed circuit board, wherein the plug portion has at least two contact arms, which are connected to one another in an electrically conductive manner, and wherein the fastening region has at least two fastening feet for fastening to the first printed circuit board, all of the at least two contact arms are arranged between the fastening feet in the direction of the longitudinal axis and the fastening feet are located further away from the longitudinal axis in the transverse direction than the contact arms extend in the transverse direction.

6. A contacting device comprising:

a plurality of contact elements, each contact element including a fastening region having fastening feet for fastening to a first printed circuit board and a plug portion for a plug connection to a second printed circuit board, wherein the plug portion has at least two contact arms, which are connected to one another in an electrically conductive manner; and an insulating body, in which, for each contact element, at least one fastening opening is formed in each case, in which the respective contact element is held, wherein the at least two contact arms of each contact element project from an upper side of the insulating body and the fastening feet of the contact elements project from an underside of the insulating body, wherein the insulating body has at least two upwardly projecting adjusting pins on an upper side of the insulating body, wherein the adjusting pins are longer than the contact arms of the contact elements, and wherein each of the adjusting pins has a tapering end.

7. A printed circuit board arrangement comprising:

at least one contact element including a fastening region and a plug portion, wherein the plug portion has at least two contact arms which are connected to one another in an electrically conductive manner;

a first printed circuit board, to which the at least one contact element is fastened via the fastening region; and a second printed circuit board, which, for each of the at least one contact element, has at least one printed circuit board opening for inserting the at least two contact arms of the respective contact element, and wherein a contact socket is mounted at each printed circuit board opening, wherein the contact socket has a smaller opening than the printed circuit board opening and the opening of the contact socket is aligned with the printed circuit board opening.

8. The printed circuit board arrangement as claimed in claim 7, wherein a metallic coating is applied to each printed circuit board opening.

9. A printed circuit board arrangement comprising:

at least one contact element including a fastening region and a plug portion, wherein the plug portion has at least two contact arms which are connected to one another in an electrically conductive manner;

a first printed circuit board, to which the at least one contact element is fastened via the fastening region; and a second printed circuit board, which, for each of the at least one contact element, has at least one printed circuit board opening for inserting the at least two contact arms of the respective contact element, and wherein the printed circuit board opening or an associated contact socket forms a slot shape in the longitudinal direction of the at least one contact element and the contact arms of the at least one contact element contact opposing sides of the slot shape.

10. The printed circuit board arrangement as claimed in claim 9, wherein a width of the slot shape of the printed circuit board opening is smaller than a width of the contact element, which is defined by the at least two contact arms, so that, in the assembled state, the at least two contact arms are deformed by the slot shape of the printed circuit board opening.

11. A printed circuit board arrangement comprising:

at least one contact element including a fastening region and a plug portion, wherein the plug portion has at least two contact arms which are connected to one another in an electrically conductive manner;

a first printed circuit board, to which the at least one contact element is fastened via the fastening region; and a second printed circuit board, which, for each of the at least one contact element, has at least one printed circuit board opening for inserting the at least two contact arms of the respective contact element, wherein, to position fastening feet of the fastening region of the at least one contact element relative to the first printed circuit board, each of the at least one contact element has at least one supporting leg which stands on the first printed circuit board in the assembled state, and wherein the at least two contact arms are arranged such that the contact arms form a gap with respect to the first printed circuit board in the assembled state.

12. The printed circuit board arrangement as claimed in claim 11, wherein each contact element has a respective supporting leg between mutually adjacent ones of the at least two contact arms.

* * * * *